US005701277A

United States Patent [19]

Ring et al.

[11] Patent Number: 5,701,277

[45] Date of Patent: Dec. 23, 1997

[54] ELECTRO-ACOUSTIC TRANSDUCERS

[75] Inventors: Martin D. Ring, Portsmouth; Roger Mark, Barrington; Peter F. Flanagan, Cranston; Patrick M. Brogan, Bristol; James R. Sturges, Barrington, all of R.I.

[73] Assignee: Raytheon Company, Lexington, Mass.

[21] Appl. No.: 779,580

[22] Filed: Jan. 17, 1997

Related U.S. Application Data

[63] Continuation of Ser. No. 619,771, Nov. 28, 1990, abandoned.

[51] Int. Cl.[6] ..... H04R 17/00

[52] U.S. Cl. ..... 367/163; 367/174; 310/337

[58] Field of Search ..... 367/163, 174, 367/159, 167, 168, 172; 310/337

[56] References Cited

U.S. PATENT DOCUMENTS

| | | | |
|---|---|---|---|
| 3,277,433 | 10/1966 | Toulis | 367/174 |
| 4,420,826 | 12/1983 | Marshall, Jr. et al. | 367/167 |
| 4,706,230 | 11/1987 | Inoue et al. | 367/174 |
| 4,862,429 | 8/1989 | Rolt | 367/165 |
| 4,901,293 | 2/1990 | Kuhn | 367/168 |

FOREIGN PATENT DOCUMENTS

| | | |
|---|---|---|
| 005409 A2 | 5/1979 | European Pat. Off. . |
| WO 87/05772 A1 | 9/1987 | WIPO . |
| WO 87/05773 A1 | 9/1987 | WIPO . |

*Primary Examiner*—J. Woodrow Eldred

*Attorney, Agent, or Firm*—Donald F. Mofford; Glenn H. Lenzen, Jr.

[57] ABSTRACT

A flextensional transducer for use in surface ship applications requiring the capability of withstanding underwater explosive shock is described. The transducer includes a plurality of ceramic stacked drivers disposed between an elliptical outer shell having opposing slots disposed along an inner surface of the shell and a flextensional limiting support block. The drivers are mounted on ball joint sockets which allow pivoting during high acceleration loading conditions. The support block further has a pair of curved surfaces which will generally follow, in close proximity, the inner surface of the shell and a member coupled to the opposing slots of the elliptical shell. The block can be fixed to a rigid mount disposed over at least one end of the transducer using a plurality of tie rods.

16 Claims, 6 Drawing Sheets

ELECTRO-ACOUSTIC TRANSDUCERS

This application is a continuation of application Ser. No. 07/619,771 filed Nov. 28, 1990, abandoned.

BACKGROUND OF THE INVENTION

This invention relates generally to electro-acoustic transducers and more particularly to flextensional transducers.

As is known in the art, a transducer is a device that converts energy from one form to another. In underwater acoustic systems, transducers generally are used to provide an electrical output signal in response to an acoustic input which has propagated through a body of water, or an acoustic output into the body of water in response to an input electrical signal.

In underwater acoustic systems, a transducer designed primarily for producing an electrical output in response to an acoustic input is called a hydrophone. Hydrophones are typically designed to operate over broad frequency ranges and are also generally small in size relative to the wavelength of the highest intended operating frequency.

A transducer intended primarily for the generation of an acoustic output signal in response to an electrical input is generally referred to as a projector. Projector dimensions are typically of the same order of magnitude as the operating wavelength of the projector. Moreover, projectors are generally narrowband devices, particularly compared to hydrophones. Both hydrophone and projector transducers are widely employed in sonar systems used for submarine and surface-ship applications.

Projectors generally include a mechanically driven member such as a piston, shell, or cylinder and a driver. The driver is responsive to electrical energy and converts such energy into mechanical energy to drive the mechanically driven member. The driven member converts the mechanical energy into acoustic waves which propagate in the body of water. Most acoustic transducers have driver elements which use materials having either magnetostrictive or piezoelectric properties. Magnetostrictive materials change dimension in the presence of an applied magnetic field, whereas piezoelectric materials undergo mechanical deformation in the presence of an electrical field. A common piezoelectric driver is the ceramic stacked driver which is made up of individual ceramic elements which are stacked with alternating polarities. In this stacking arrangement, the ceramic stack is longitudinally polarized. Electrical drive is applied to the elements of the ceramic stack and in response, each element expands and contracts in the longitudinal direction. The individual element displacements accumulate to provide a net displacement of the stack.

Because acoustic transducers are used in a wide variety of applications, their size, shape and mode of operation can be quite different.

A common configuration for acoustic transducers used in underwater environments is the longitudinally polarized cylindrical projector, known commonly as the Tonpilz projector. The Tonpilz projector makes use of a stack of cylindrical ceramic elements mounted between a stationary baseplate, called the tail mass, and a movable solid metal piece with a flat circular, or piston-like, face called the head mass. A metal rod through the center of the ceramic stack connects the tail mass to the head mass and compresses, or prestresses, the ceramic elements so that they are protected from tensile forces which are generally detrimental to ceramic piezoelectrics.

The low cost and simplicity of design of the Tonpilz projector makes it one of the most popular projector configurations in use today. In addition, because the Tonpilz projector has relatively few parts, it can easily be made shock resistant by tightly wrapping the cylindrical stack and providing sufficient prestress to the ceramic stack driver.

Accordingly, for underwater shock environments, the Tonpilz projector became, by default, the transducer of choice for these applications. However, because the size of acoustic transducers in general is inversely proportional to their operating frequency, the Tonpilz projectors are relatively large and heavy, particularly at low acoustic frequencies. Further, the Tonpilz projector has a relatively low efficiency in converting electrical energy to acoustic energy compared with other projector configurations.

Another projector which is commonly used when light weight, small size and/or high efficiency is needed, is the so-called flextensional transducer. One known flextensional transducer (the so called "Class IV flextensional transducer") includes a rectangular ceramic driver mounted within and along the major axis of an elliptically shaped shell. Prestress is applied to the driver by compressing the shell along its minor axis, thereby extending the major axis dimension allowing a slightly oversized ceramic stack driver to be placed along the major axis. Releasing the compressive force applied to the elliptical shell places the driver in compression. With this configuration, the elliptical shell acts as a mechanical impedance transformer between the driving element and the medium, such as a body of water, in which the transducer is disposed. In some flextensional configurations, the ceramic stack is made in two parts and the pair of ceramic drivers are separated with a support structure, having an I-beam frame disposed across the minor axis of the elliptical shell for providing a mounting surface for endplates at each end of the shell. The endplates seal the transducer and protect the inner components from the outside medium. As used in this manner, the support structure provides a thermal path for dissipating heat generated in the ceramic stack driver. This heat sinking feature can be very important in high power applications. The dynamic excitation of the ceramic stack driver causes the stack to expand and contract. A small velocity imparted at the ends of the ceramic stack is converted to a much larger velocity at the major faces of the elliptical shell resulting in the generation of an acoustic field within a medium in which the transducer is disposed. It is generally desired for good electro-acoustic efficiency that contact is made to the drive points of the shell only by the ceramic stack assembly. The support structure and end plates are generally physically isolated from the shell. In this arrangement, the flextensional transducer is said to be "air-backed", that is, air is disposed in contact with the shell and the support structure.

Because the flextensional transducer generally includes a large volume of drive ceramic, it is generally more efficient and can handle higher power over a broader bandwidth while being smaller and lighter than a Tonpilz projector operating at a similar acoustic frequency.

Unlike Tonpilz projectors, flextensional transducers are not easily shock hardened for use in hostile environments where underwater explosions can occur. In these situations, very high hydrodynamic pressure conditions provide high pressure levels capable of causing the air-backed shell to collapse, or at the very least, to yield from flexure. This can result in a deformed shell geometry, making it unusable as an acoustic source. Further, high acceleration loading, caused by the motion of a vessel, to which the flextensional transducer is attached, can jeopardize the ceramic driver mounted within the elliptical shell. At the onset of the shock brought on by an underwater explosion, the shell would start to travel transversely with respect to its ship mounting means. The ceramic driver, which is under high compression and mounted along the major axis of the elliptical shell, would be subjected to high self-inertial loads and would begin to bend. Piezoelectric materials, like the ceramic used in these applications, typically can withstand very high compressive forces but easily fracture when subjected to tensile forces. In cases where the ceramic driver is housed in a support structure, the travelling shock waves can also displace the shell from the support and ceramic driver resulting in an inoperable flextensional transducer. Because flextensional transducers may have application during wartime in hostile environments, there is a need for flextensional transducers capable of surviving underwater explosive shock.

As was stated earlier, during an underwater explosion, travelling shock waves with very high hydrodynamic pressure levels are generated. These pressure levels are of such magnitude that a vessel's motion, in response to the travelling waves, may produce high levels of acceleration loading. In applications where the acoustic transducer is mounted to the hull of a surface ship or submarine, this indirect source of acceleration may be sufficient to damage the transducer and possibly shear a conventional mount from the hull of a ship or submarine. Therefore, for hull mounted transducers, a shock mount capable of mitigating the high accelerative forces should be required. Conversely, in applications where the transducer is not mounted to a vessel, such as in a towed body application, indirect acceleration loading levels are significantly less. Accordingly, in such applications, a shock mount is generally not required.

SUMMARY OF THE INVENTION

In accordance with the present invention, a flextensional transducer includes a shell having inner portions and an electromechanical driver having end portions coupled to inner portions of the shell. The flextensional transducer further includes means for limiting the displacement of the electromechanical shell. Such limiting means, for example, includes a support having a pair of curved surfaces, each curved surface generally following a portion of an inner surface of the shell with the curved surfaces being disposed proximate to the inner surface of the shell. Further, the limiting means may include the support having a pair of alignment recesses disposed on end portions of the support structure and a pair of endcaps having alignment keys for matching to the pair of alignment recesses of the support structure. Further still, the limiting means may include an elongated strut member having ends disposed within a pair of opposing slots disposed in the shell. With such an arrangement, a flextensional transducer is provided which can be used in an environment where high hydrodynamic pressure levels are encountered, such as in the vicinity of an underwater explosion. The support provides mechanical support for the shell and limits flexure of the shell during underwater shock conditions. Further, the pair of curved surfaces disposed proximate to the inner surface of the shell prevents collapse or permanent deformation of the shell due to underwater explosive shock. Further still, the elongated strut member engages the pair of opposing slots in the shell during high hydrodynamic accelerations to generally prevent displacement of the shell from the electromechanical drivers.

In accordance with a further aspect of the invention, a flextensional transducer includes a shell and an electromechanical driver disposed along an axis of the shell. The flextensional transducer further includes a support structure having a pair of curved surfaces which generally follow an inner surface of the shell, with the curved surfaces being disposed proximate to corresponding inner surfaces of the shell. With such an arrangement, a flextensional transducer is provided with a support having a pair of surfaces which closely follows the internal profile of the shell. During an underwater explosion, shock waves having very high hydrodynamic pressure levels sufficient for causing the air-backed shell to collapse are present. The support structure with the pair of curved surfaces prevents damaging levels of deformation of the shell when subjected to such high hydrodynamic pressure waves.

In accordance with a further aspect of the invention, a flextensional transducer includes a shell having a pair of opposing slots disposed along an inner surface of the shell and a support structure having means for housing an electromechanical driver and a member coupled to the opposing slots in the shell. With such an arrangement, a flextensional transducer is provided having a member disposed to limit the displacement of the shell from the electromechanical driver. Travelling shock waves generated by an underwater explosion can cause the shell to rotate about the stationary support structure housing the electromechanical driver. This rotation can displace the electromechanical driver from the drive points of the shell resulting in an inoperable flextensional transducer. The shell, having opposing slots disposed along the inner surface thereof, and the member coupled to the opposing slots generally inhibits the shell from being displaced from the support structure and electromechanical driving means.

In accordance with a further aspect of the invention, a flextensional transducer includes a shell, an electromechanical driver, and pivoting means disposed at each end of the electromechanical driver for allowing the electromechanical driver to pivot in response to travelling shock waves. With such an arrangement, a flextensional transducer having pivoting means disposed at the point of contact between the shell and electromechanical driver is provided for mitigating bending stresses in the electromechanical driver induced by travelling shock waves generated by an underwater explosion. Such an arrangement will reduce or alleviate tensile forces within the electromechanical driver.

In accordance with a further aspect of the invention, a mount includes a fixture support plate, having at least a first aperture disposed therethrough. The mount further includes a first isolator member, having at least a second aperture aligned with the at least first aperture and a second isolator member, having at least a third aperture aligned with the at least first aperture of the fixture support plate. The first and second isolator members are each disposed over first and second surfaces of the fixture support plate. The mount further includes at least one energy absorbent bushing, having an aperture disposed in and aligned with the at least first aperture of the fixture support plate. With such an arrangement, a mount for securing a transducer to a rigid surface, such as a hull of a submarine or surface ship, is provided. During an underwater explosion, travelling shock waves incident on a vessel generate very high acceleration loading conditions. The shock mount provides mechanical isolation between the transducer and the vessel in response to accelerative forces generated by the vessel subjected to travelling shock waves.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
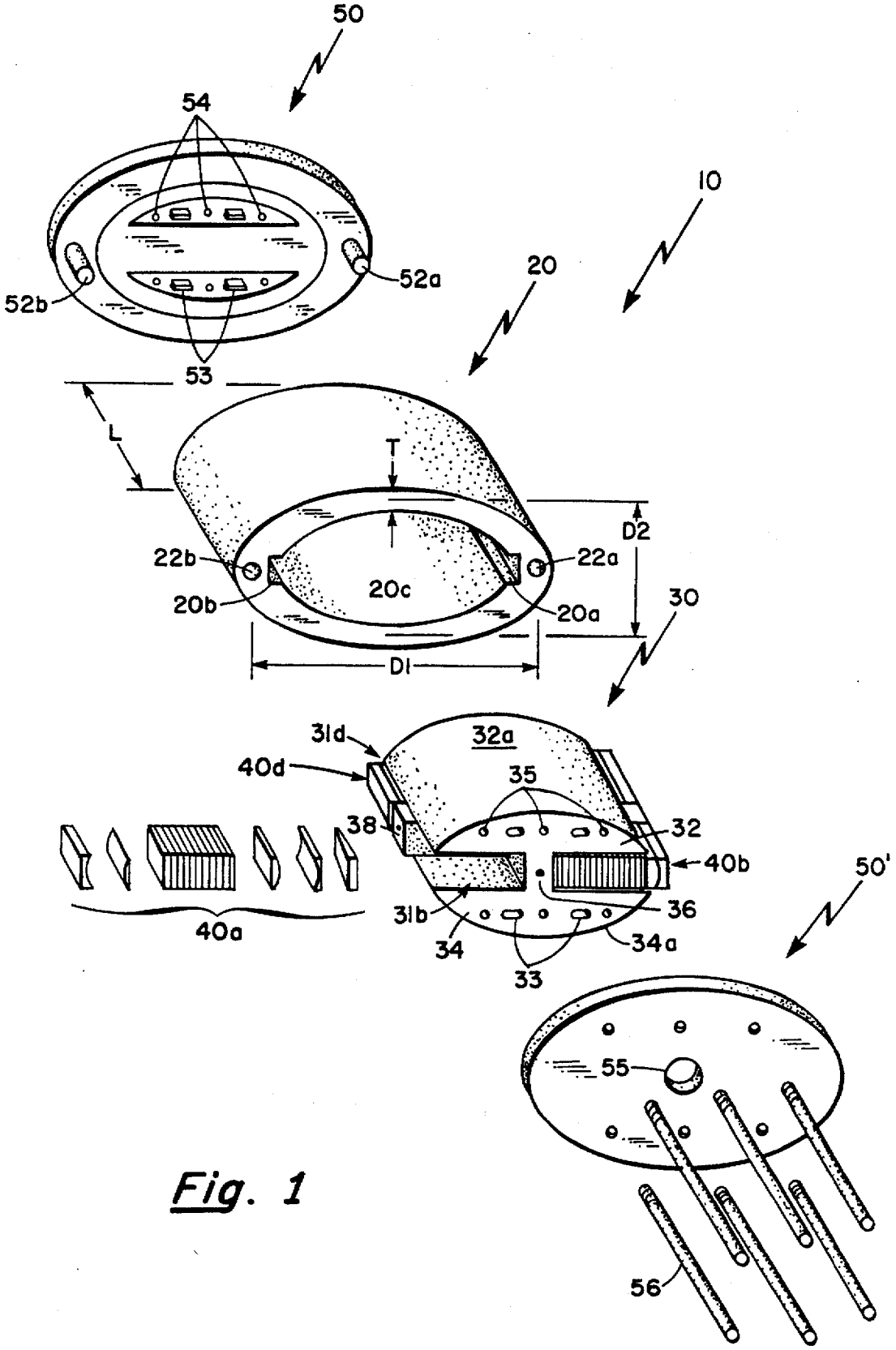
FIG. 1 is an exploded, somewhat diagrammatical, isometric view of a shock hardened flextensional transducer.
Figure 3:
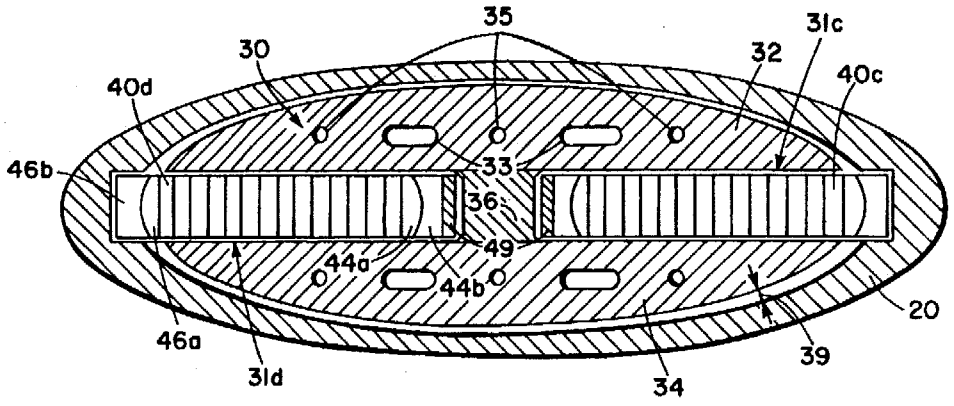
FIG. 3 is a cross-sectional view of a portion of a flextensional transducer taken along lines 3—3 of FIG. 2.

Referring now to FIGS. 1–4, a flextensional transducer 10 is shown to include an oval or elliptical shell 20 having a predetermined midwall major diameter (D1), midwall minor diameter (D2), wall thickness (T), and an axial length (L) for providing a required acoustic performance characteristic. Further, the elliptical shell 20 includes a pair of opposing slots 20*a*, 20*b* disposed along the major diameter of the inner surface 20*c* of the shell 20, as shown. Elliptical shell 20 further has a pair of elongated endplate holes 22*a*, 22*b* having a predetermined depth disposed within ends of the elliptical shell which engage endplates 50, 50' during an explosive shock, as will be further described.

The transducer 10 further includes a support block 30 having a pair of spaced here, hemielliptical solid members 32, 34 coupled together by a pair of cross members 36, 38 to provide a plurality of here four compartments. Here, the support is machined from a solid block of aluminum but could also have been provided by individual machined components. The spaced hemielliptical solid members 32, 34 have a pair of continuous curved surfaces 32*a*, 34*a* which generally follow the contour of inner surface 20*c* of the shell 20. When the support 30 is disposed in shell 20, the curved surfaces 32*a*, 34*a* are also disposed in close proximity to the inner surface 20*c* of the shell 20 providing a clearance space 39 (FIG. 3) between the surfaces 32*a*, 34*a* and the shell 20.

In one embodiment, the clearance space 39 between the support block 30 and the elliptical shell 20 is about 10 mils (10/1000 inch) at the minor diameter of the elliptical shell 20, tapering down to 6 mils near the major diameter for an elliptical shell 20 having a major diameter D1 of about 11 inches, a minor diameter D2 of about 5 inches, and a wall thickness T of about 0.75 inches. The clearance space 39 should be sufficient to allow the shell 20 to oscillate freely during operation without contacting internal parts other than the electromechanical driver assemblies 40*a*–40*d* but should be close enough to prevent undesirable flexure of the shell during an underwater explosion or the like.

The support block 30 having the compartments 31*a*–31*d* have disposed therein electromechanical driver assemblies 40*a*–40*d*. One of said cross members 38 is a rectangular key strut disposed central to the support block 30 and is arranged to be disposed within the slots 20*a*, 20*b* in elliptical shell 20 when the support is disposed in the shell.

Figure 4:
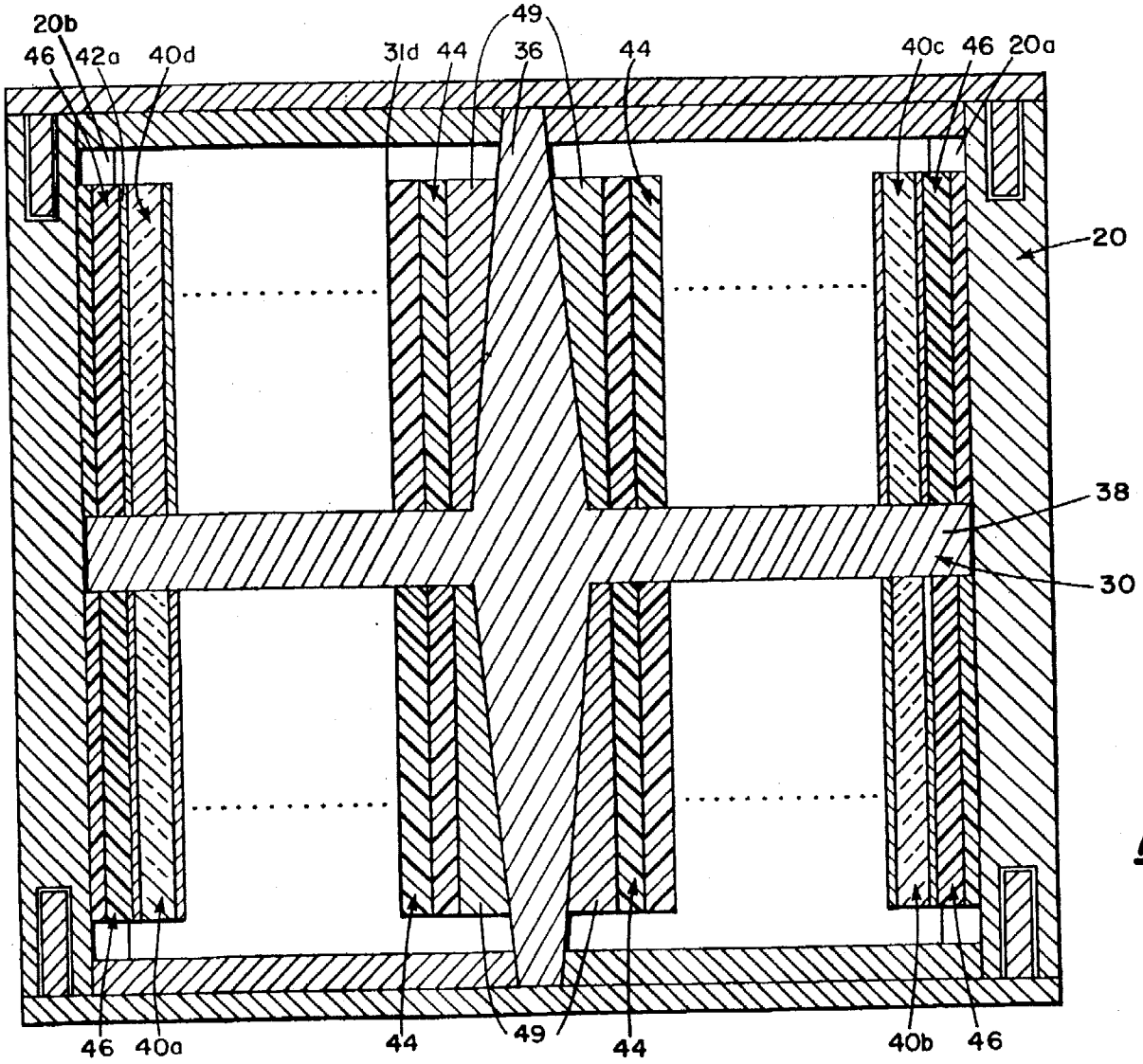
FIG. 4 is a longitudinal cross-sectional view of a portion of a flextensional transducer taken along lines 4—4 of FIG. 2.

Referring now to FIG. 4, the second cross member 36 is a wedge strut disposed central to and along the axial length of the support block 30 and has a width at the junction of the key strut 38 which tapers down to a reduced width at the support block ends, as is particularly shown in FIG. 4. The four wedge strut surfaces are tapered at an angle complementary to the angle of the triangular wedge section 49, as shown in FIG. 4. The end portions of the support block have a plurality of, here, six thru-holes 35 for guiding press fit threaded tie rods 36 to the flextensional transducer 10. The tie rods 56 provide rigidity and strength to the support block 30 and directly couple the support block to the endplates 50, 50'. Further, a plurality of alignment apertures 33 are provided at the ends of the support block for providing means for mating to a plurality of alignment keys 53 disposed on inner surfaces of end plates 50, 50'.

The flextensional transducer 10 further includes a pair of endplates 50, 50', here identical, with the exception of a connector hole 105 at the center of endplate 50' for providing access for wiring generally required for supplying power to electromechanical drivers 40*a*–40*d*. In combination with seal gaskets (not shown), the endplates are used to provide a watertight seal to enclose the support block 30 within the medium of the shell 20. The inner surfaces of endplates 50, 50' have alignment keys 53 disposed to match corresponding recesses 33 and end portions of the support block 30. In addition to alignment, the keys 53 add strength and rigidity to the tie rod connections between the endplates 50, 50' and support block 30. Further, a pair of endplate pins 52*a*, 52*b* are provided within the elongated endplate holes 22*a*, 22*b* of the elliptical shell 20 when the end plates are assembled to the shell. As will be discussed later, the elongated endplate holes 22*a*, 22*b* are oversized with respect to endplate pins 52*a*, 52*b* and preferably no physical contact is made during normal operation. The end plates 50, 50' further include thru-holes 54 for tie rods 56.

Figure 5:
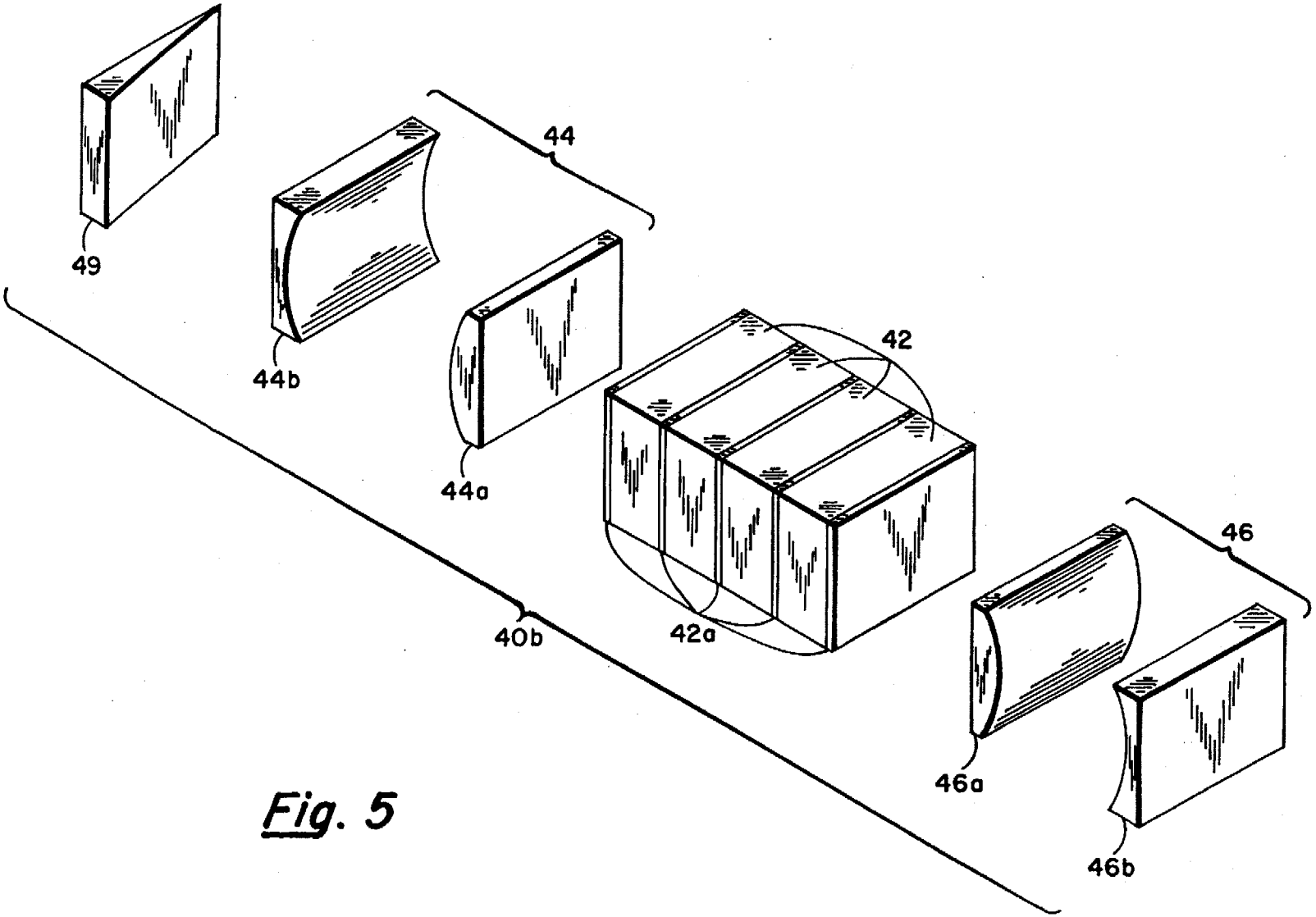
FIG. 5 is an exploded view of a electromechanical driver assembly used in the flextensional transducer.

Referring to FIG. 5, an exemplary one 40*b* of electromechanical driver assembly 40*a*–40*d* is shown to include a stack of rectangular, here PZT (lead-zirconate, lead-titanate), ceramic bars 42 having beryllium copper foil electrical conductors 42*a* disposed between individual ceramic segments and laminated together with epoxy glue, as is generally known in the art. The polarity of the ceramic bars are alternated at every other electrode and a negative polarity is present at both ends of each stack, as shown. The laminated ceramic stack driver 42 is disposed between a pair of ball joints 44, 46. Each ball joint 44, 46 includes a planar convex member 44*a*, 46*a* which mates with a corresponding planar concave member 44*b*, 46*b*, as shown. The planar sides of each member 44*a*, 46*a* mate with each end of the ceramic driver 42, whereas the planar surfaces of members 44*b*, 46*b* mate with a prestress wedge 49 and portions of shell 20, as shown in FIG. 4. The planar surfaces of ball joint segments 44*b*, 46*b* are also generally polished. Ball joints 44, 46 are made from an electrically insulative material such as fiberglass plastic to electrically and structurally isolate the electromechanical driver assembly from the surfaces of the elliptical shell 20 and the support block 30. The triangular wedge section 49 is disposed between one end of electromechanical driver 40 and support block 30 to prestress the stack, as will be described.

Referring again to FIGS. 1–4, the electromechanical driver assemblies 40*a*–40*d* (FIG. 4) are disposed in the compartments 31*a*–31*d* provided in the support block 30 under a predetermined compression or "prestress" condition. Prestress compression on the ceramic stack is necessary for generally preventing damage to the ceramic stack due to tensile stresses induced by the applied electrical signal. Prestress is generally applied in a flextensional transducer by compressing the elliptical shell along its minor axis, thereby extending the major axis for insertion of the electromechanical driver. When the compressive force on the elliptical shell is removed, the shell returns to its uncompressed shape, which causes ends of the shell to provide a compressive force on the drive assembly. That is, the assembly is said to be "preloaded" or prestressed between the ends of the shell. In the preferred embodiment, due to the small clearance space 39 between the support block 30 and the elliptical shell 20, the required preload is not easily provided by this technique. Here, prestress is provided to the driver assemblies 40*a*–40*d* in the flextensional transducer by disposing triangular wedge sections 49 between surfaces of wedge strut cross member 36 of the support block 30 and inner ball Joint segments 44*b*. Triangular wedge sections 49 are fabricated from aluminum, are highly polished and lubricated, and are driven into position using external pressing means.

Figure 2:
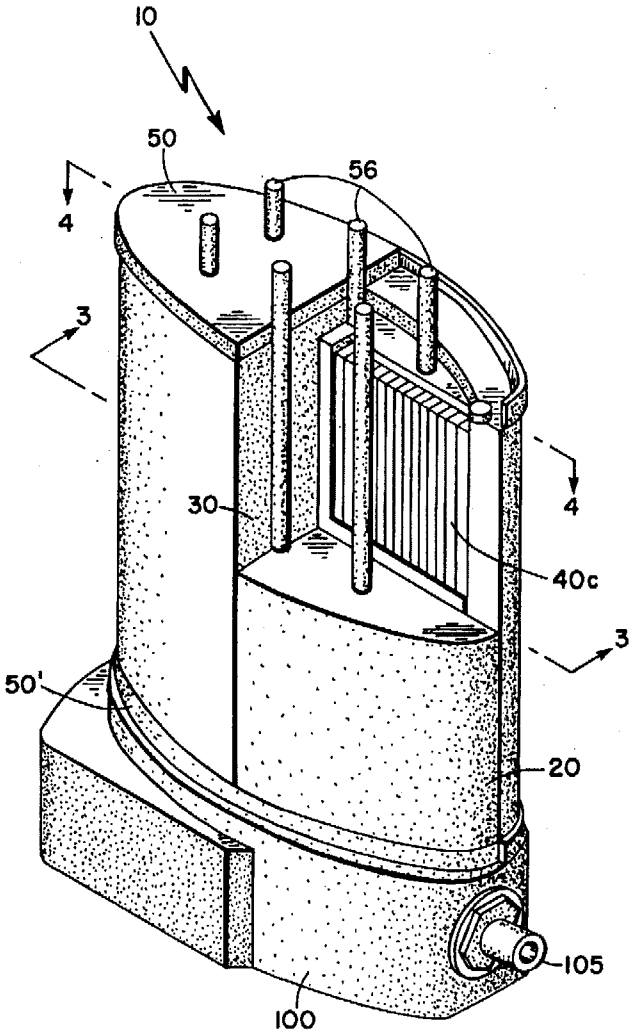
FIG. 2 is an isometric view, partially broken away, of an assembled shock hardened flextensional transducer.

Referring in particular to FIG. 2, in operation, an electrical signal is applied to connector 105 of a transformer assembly 100. The transformer (not shown) and the transformer assembly converts a relatively low voltage into a relatively high voltage to drive the ceramic stack assembly 42 and to provide impedance matching required for obtaining maximum power transfer to the ceramic stack 42. Voltage signals provided from transformer assembly 100 are supplied to individual ceramic elements of the ceramic stack assembly 42. With voltage applied to the conducting electrodes 42*a*, each element expands and contracts longitudinally and a net displacement of the electromechanical driver 40 is provided. Longitudinal expansion of the electromechanical driver 40 causes the elliptical shell 20 to move outward at the drive points, providing a compressive force upon the medium, such as the water, surrounding the flextensional transducer 10. Conversely, contraction in the electromechanical driver 40 causes the elliptical shell 20 to become less convex to produce a rarefaction of the medium surrounding transducer 10. Initially, a flextensional transducer 10 converts electrical energy to acoustic waves for propagation into the body of water.

As was previously mentioned, the curved surfaces 32, 34 of the support block 30 closely follow the inner surface of the elliptical shell 20. Such an arrangement provides an air-backed flextensional transducer 10 which can be used in an environment where high hydrodynamic pressure levels are encountered, such as in the vicinity of an underwater explosion. The support block 30 provides an internal mechanical support for the elliptical shell 20 to limit the flexure of the elliptical shell wall during underwater shock conditions. The clearance space 39 between the support block and the shell is sufficiently constricted to prevent collapse or permanent deformation of the elliptical shell due to underwater explosive shock. The support block 30 in flextensional transducer 10 also provides a heat sink for the electromechanical driver 40 in addition to the shock hardening feature discussed above. Preferred thermal heat sinking is provided by encapsulating the driver in a thermally conductive encapsulant such as an epoxy manufactured by Emerson and Cummings, Product No. EC-5019, as discussed in co-pending application Ser. No. 08/082,828, now U.S. Pat. No. 5,291,467, filed on Jun. 25, 1993 by J. R Sturges, R. W. Boeglin, R. J. Weeden, entitled "Elastomer Structure for Transducers" and assigned to the assignee of the present invention.

The rectangular key strut 38 is disposed within opposing slots 20*a*, 20*b* disposed at the major diameter of the inner surface of the elliptical shell 20. The rectangular key strut 38 engages the slots under high hydrodynamic accelerations to prevent displacement of the drivers from end portions of the shell. Under normal operation, the slots 20*a*, 20*b* and strut 38 do not engage or contact each other. Non-contact is maintained by tie rod 56, support block 30, and endplate 50, 50' coupling.

In addition, the endplates 50, 50' have a pair of endplate pins 52*a*, 52*b* for coupling to elongated shell holes 22*a*, 22*b* disposed at the major diameter of the elliptical shell 20. As above, sufficient clearance is provided between the endplate pins 52*a*, 52*b* and shell holes 22*a*, 22*b* for providing no physical contact between both support block 30 or endplates 50, 50' during normal operation. However, in the event of an underwater explosion, the clearances are small enough for engagement of pins 52*a*, 52*b* and shell holes 22*a*, 22*b* in response to shock waves caused by explosions. The endplate pins 52*a*, 52*b* terminate the acceleration of the non-contacting elliptical shell 20 and help prevent possible damage to both elliptical shell 20 and support block 30 during the onset of a the travelling shock wave. Further, the plurality of alignment keys 53 disposed on inner surfaces of endplates 50–50' for mating with alignment apertures 33 disposed on both ends of support block 30 generally increases the effectiveness of the support block 30 by providing additional rigidity to the support block 30. The endplates 50–50' also have surfaces which will engage the shell 20 during shock. These features are especially critical in applications where the flextensional transducer 10 is mounted to a stationary mounting surface.

Referring now to FIG. 5, electromechanical driver 40*b*, here an exemplary one of electromechanical drivers 40*a*–40*d* thereof has the pair of ball joint sections 44, 46 separated by the ceramic stack 42 for allowing the ceramic stack to pivot from at either or both ends during underwater explosive conditions. Due to the crystalline nature of the ceramic material used in fabricating the ceramic stack 42, the individual ceramic elements generally have a low tolerance of bending or tensile stresses. The pivoting mechanism provided by ball joint sections 44, 46 substantially alleviates any bending stresses induced by a travelling shock wave by decoupling the ceramic stack 42 from the support block 30 and elliptical shell 20 under these dynamic conditions.

Figure 6:
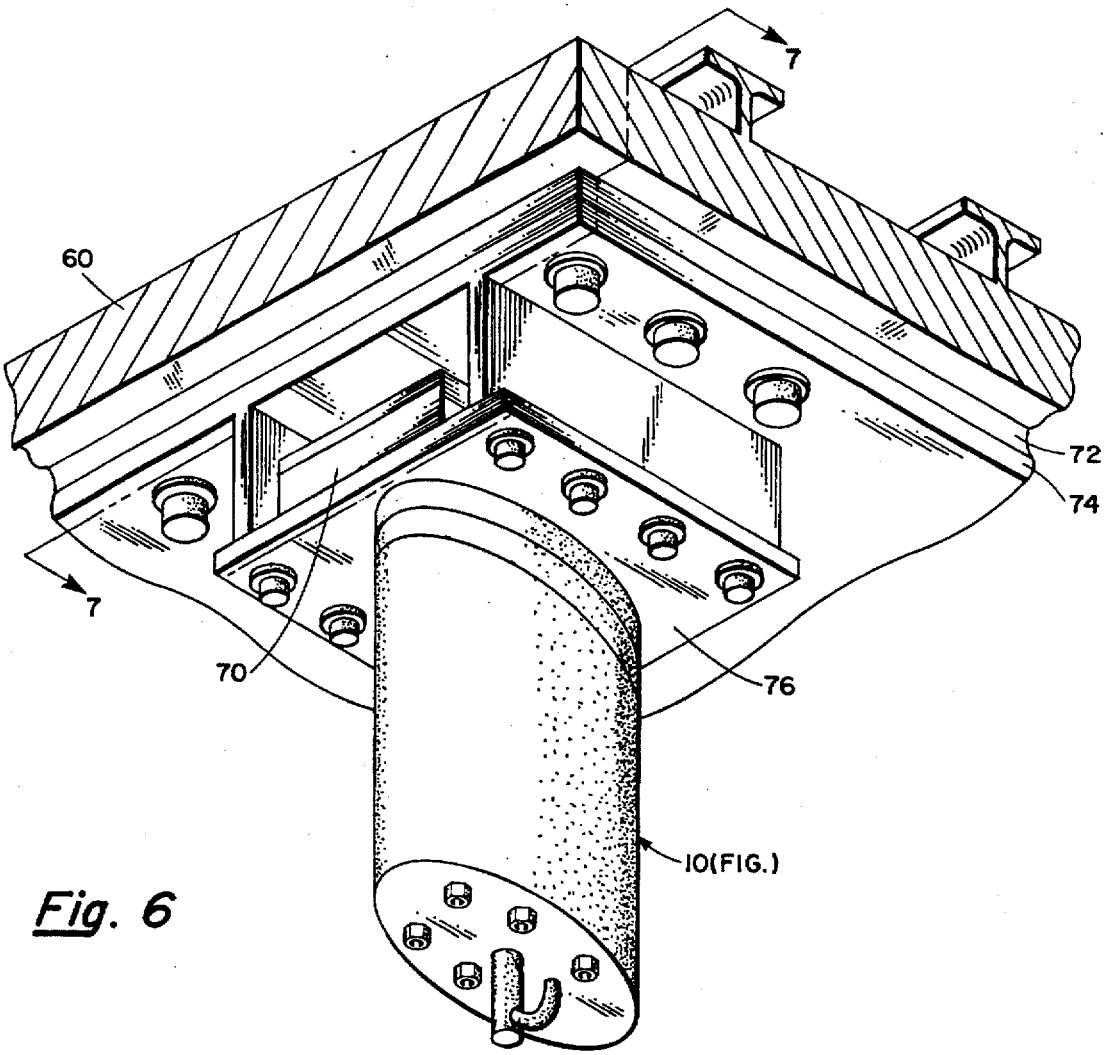
FIG. 6 is an isometric view, partially broken away, of a shock mount assembly disposed between a shock hardened flextensional transducer and a hull of a ship.
Figure 7:
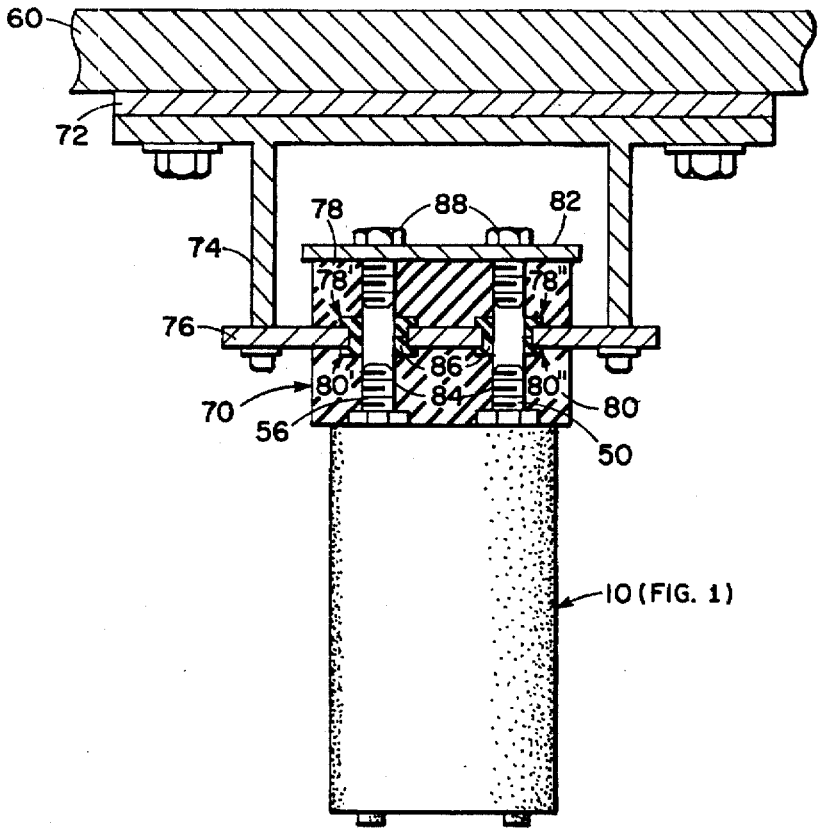
FIG. 7 is a cross-sectional view of a shock mount assembly taken along lines 7—7 of FIG. 6.

Referring to FIGS. 6–7, a flextensional transducer 10 attached to a portion of a hull of a ship 60 is shown. For such an application, it is generally required that a shock mount assembly 70 be disposed between the hull 60 and the transducer 10 for absorbing high hydrodynamic accelerative forces typical of an underwater explosive shock. Further, the shock mount 70 may also provide isolation between the flextensional transducer and structure borne noise generated on or by the moving vessel, such as machinery noise and hydrodynamic noise. This isolation characteristic has increased importance in applications where a mounted transducer 10 is used as an acoustic receiver.

Referring now to FIG. 7, a fixture weld plate 72 is shown to be welded to a portion of the hull 60. A fixture bracket 74, having a pair of rigid vertical arms, is coupled to the fixture weld plate 72 and provides means for supporting a fixture support plate 76 of the shock mount 70. Energy absorbent isolator members 78, 80 are disposed on top and bottom surfaces of the fixture support plate 76 for absorbing shock waves incident at angles normal to the shock mount assembly 70. The isolator members 78, 80 have recesses 78', 78" and 80, 80" as shown and are here fabricated from a micro-cellular, polyurethane material such as PORON, which is a trademark of Rogers Corporation, East Woodstock, Conn. The polyurethane isolator members 78, 80 have characteristics of providing collapse resistance and vibration damping under high accelerative loading conditions. A steel load plate 82 is disposed on an upper surface of the top isolator member 78 for distributing the load to member 78 and providing mechanical support and rigidity to the isolator assembly. The fixture support plate 76 and isolator members 78, 80 have thru holes coaxially disposed therein for receiving a plurality of coupling rods 84. Each one of the coupling rods have tapped holes with predetermined depths disposed in the end portions of the rod. Threaded tie rods 56 of the flextensional transducer 10 are coupled to one end of the coupling rods 84 and steel bolts 88 are coupled to the other end of the rod for securing the coupling rods 84 to the shock mount assembly 70. Shock absorbing bushings 86 are disposed within recesses 78', 78", 80', and 80" of the isolator members 78, 80 as shown in the region of the isolator member 78, 80 disposed adjacent to the fixture support plate. Coupling rods are disposed through the bushings 86 to absorb accelerative loading forces generated by the inertia of the vessel in response to an underwater shock. The energy absorbent bushings 86 are here fabricated from a urethane material such as ENDUR-C, a product of Rogers Corporation, East Woodstock, Conn.

Figure 8:
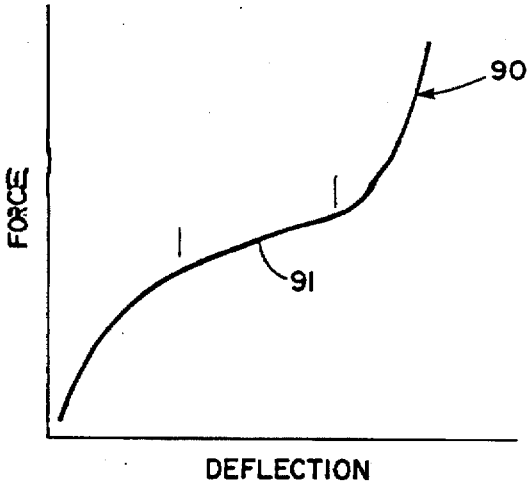
FIG. 8 is a typical plot of compressive force versus deflection for a microcellular urethane material.

The materials selected for the fabrication of isolator members 78, 80 and energy absorbent bushings 86, as stated earlier, are microcellular urethanes having a structure of uniformly closed, small cells. FIG. 8 shows a typical compressive force/deflection curve representing a stiffness characteristic for such materials. Unlike other elastomer materials, the microcellular urethane has a stiffness characteristic 90 having a quasi-linear region 91, as shown in FIG. 8, where a large change in deflection is experienced with a relatively small change in applied force. In this quasi-linear region 91, the material is allowed to spread the impact of the force over a longer period of time. The PORON urethane used for the isolator members 78, 80 has a density range preferably between 15–30 lbs/ft$^3$, here 20 lbs/ft$^3$ and the ENDUR-C urethane used for the bushings 86 has a density range of 30–50 lbs/ft$^3$, here 40 lbs/ft$^3$. Because it is generally desirable to have a shock mount 70 equally responsive to shock forces from all directions, the bushing material is typically desired to have a density and stiffness characteristic greater than that of the isolator member material. The bushing material provides better shock absorption to transverse forces incident to the transducer 10 and shock mount 70. The ratio between the densities is generally directly related to the ratio between contact surface areas of the isolator members 78, 80 to the fixture support plate and the energy absorbent bushings 86 to the fixture support plate. Further, in order to ensure that the urethane materials have stiffness characteristics within the linear region, it is generally required that the isolator members 78, 80 and bushings 86 be prestressed. The isolator members 78, 80 are prestressed by applying a predetermined torque to bolts 88. To provide a prestressed shock mount, the coupling rods are generally required to have heights less than the height of isolator members 78, 80 and fixture support plate 76 in combination for allowing the members 78, 80 to compress. The bushings 86 have an inner dimension slightly undersized with respect to the coupling rods 84, such that the bushings 86 are likewise prestressed or compressed when placed within the recesses. Although the isolator members 78, 80 and bushings are here fabricated using two different urethane materials, in another preferred embodiment, the bushings 86 and isolator members 78, 80 having different stiffness characteristic may be fabricated from the same urethane but having different densities as required, such as ENDUR-C.

Referring back to FIGS. 7–8, the flextensional transducer and shock mount arrangement shown is generally used for testing purposes. In an actual application, an array fixture might be disposed within a fairing and mounting to a generally curved surface of the hull for supporting a plurality of transducers or other sonar components.

Having described a preferred embodiment of the invention, it will be apparent to one of skill in the art that other embodiments incorporating its concept may be used. It is believed, therefore, that this invention should not be restricted to the disclosed embodiment but rather should be limited only by the spirit and scope of the appended claims.

What is claimed is:

1. A flextensional transducer comprising:

a shell having inner portions;

an electromechanical driver having end portions coupled to inner portions of said shell;

means, including a support disposed in said shell, for limiting the displacement of said electromechanical driver from said shell, said support having a pair of rigid members, each member having a curved surface disposed to follow a portion of an inner surface of said shell with each curved surface being disposed proximate to a corresponding inner surface of said shell; and an attachment member disposed between and connected to said pair of rigid members.

2. The transducer of claim 1 wherein said shell has an axial length and a pair of elliptically shaped inner surfaces, said rigid members follow said elliptically shaped inner surfaces of said shell and have an axial length approximate to said axial length of said shell; and said attachment member is connected to said pair of rigid members at approximate midpoints of said axial lengths of said rigid members.

3. The transducer of claim 1 wherein said means for limiting displacement includes said shell having a pair of slots disposed along an inner surface of said shell and said support comprises a member having portions disposed within said slots of said shell.

4. The transducer of claim 3 wherein said slots are opposing and said member is an elongated strut member having end portions disposed within said opposing slots of said shell.

5. The transducer of claim 4 wherein said shell has an axial length and a pair of elliptically shaped inner surfaces and said elongated strut member has an axial length approximate to said axial length of said shell.

6. The transducer of claim 3 wherein said end portions of said member are not in physical contact with said slots of said shell under normal operation, but engage said slots in response to a travelling shock wave imposed on said transducer.

7. The transducer of claim 1 wherein said means for limiting displacement includes said shell having a pair of holes disposed on end portions of said shell and a pair of endplates having alignment pins disposed within said holes of said shell, said pins and holes having dimensions such that under normal operation, said alignment pins do not physically contact said holes but engage said holes in response to a travelling shock wave imposed on said transducer.

8. The transducer of claim 1 further comprising a support structure having a pair of alignment recesses disposed on end portions thereof and a pair of endplates having alignment keys for engaging to said pair of alignment recesses of said support structure.

9. The transducer of claim 1 wherein said means for limiting displacement comprises means disposed at each end of said electromechanical driver for allowing said electromechanical driver to pivot about a longitudinal axis of the electromechanical driver.

10. The transducer of claim 1 further comprising a support structure wherein said means for allowing said driver to pivot comprises a first ball joint disposed between a first end of said electromechanical driver and said support structure and a second ball joint disposed between a second end of electromechanical driver in said inner surface of said shell.

11. The transducer of claim 10 wherein said first and second ball joints each comprise a planar convex member having a planar surface and a convex surface and a planar concave member having a planar surface and a concave surface, respectively, with said concave and convex surfaces of each of the first and second ball joints being engaged.

12. A flextensional transducer comprising:

an elliptical shell;

an electromechanical driver disposed within said elliptical shell;

a pair of diametrically opposing slots disposed along an inner surface of said shell;

an elongated strut member, disposed adjacent to said electromechanical driver, having ends disposed within said opposing slots of said shell; and wherein during a mode of normal operation, said strut member is not in intimate contact with said slots of said shell and in a mode of high dynamic acceleration operation said member engages said slots of said shell.

13. A flextensional transducer comprising:

an elliptical shell;

an electromechanical driver disposed within said elliptical shell;

a support structure disposed in said shell having a pair of rigid members, each rigid member having a curved surface which generally follows a portion of an inner surface of said shell with said curved surfaces being disposed proximate to corresponding portions of inner surfaces of said shell; and an attachment member connected between said pair of rigid members.

14. A flextensional transducer comprising:

an elliptical shell;

an electromechanical driver disposed within said elliptical shell;

a support structure disposed within said shell and adjacent said electromechanical driver;

a first ball joint disposed between a first end of said electromechanical driver and said support structure; and a second ball joint disposed between a second end of said electromechanical driver and an inner surface of said shell.

15. The transducer of claim 14 wherein each of said ball joints comprises a planoconvex member having a planar surface and a convex surface and a planoconcave member having a planar surface and a concave surface, respectively, with said concave and convex surfaces of a pair of said ball joints being engaged.

16. A flextensional transducer comprising:

an elliptical shell having a pair of diametrically opposing slots disposed along an inner surface of said shell;

a pair of electromechanical drivers disposed within said elliptical shell;

a support structure disposed in said shell having a pair of compartments for housing said pair of electromechanical drivers, a pair of curved surfaces which generally follow the inner surface of said shell with said curved surface being disposed proximate to said inner surface of said shell, and a pair of alignment recesses disposed on end portions of said support structure;

a pair of endcaps having alignment keys for matching to said pair of alignment recesses of said support structure;

an elongated strut member having ends disposed within said opposing slots of said shell; and means, disposed at each end of said electromechanical driver, for allowing said electromechanical driver to pivot about a longitudinal axis of said electromechanical driver.

* * * * *